US012018881B2

(12) United States Patent
Karl et al.

(10) Patent No.: US 12,018,881 B2
(45) Date of Patent: Jun. 25, 2024

(54) ADJUSTMENT ASSEMBLY FOR APPLIANCE DOOR

(71) Applicant: WHIRLPOOL CORPORATION, Benton Harbor, MI (US)

(72) Inventors: Jackson Felipe Karl, Stevensville, MI (US); Kailash Shravan More, Maharashtra (IN); Sunil Mahadev Patil, Karnataka (IN); Vinay M. Patil, Maharashtra (IN); Chad J. Rotter, Saugatuck, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 141 days.

(21) Appl. No.: 17/532,731

(22) Filed: Nov. 22, 2021

(65) Prior Publication Data

US 2022/0163253 A1 May 26, 2022

Related U.S. Application Data

(60) Provisional application No. 63/116,992, filed on Nov. 23, 2020.

(51) Int. Cl.
*F25D 23/02* (2006.01)
*A47B 88/956* (2017.01)

(52) U.S. Cl.
CPC ..... *F25D 23/028* (2013.01); *A47B 88/956* (2017.01); *F25D 2323/021* (2013.01)

(58) Field of Classification Search
CPC ..... F25D 23/028; F25D 2323/021; F25D 23/021; F25D 25/025; A47B 88/956; B65D 25/005
See application file for complete search history.

(56) References Cited

U.S. PATENT DOCUMENTS 3,968,708 A * 7/1976 Ingersoll ..... B25B 13/14 81/157
4,090,753 A * 5/1978 Rock ..... A47B 88/956 312/330.1
8,444,238 B2 5/2013 Choi
(Continued)

FOREIGN PATENT DOCUMENTS

CN 203980778 U * 12/2014
CN 107024053 A * 8/2017 ..... F25D 11/00
(Continued)

*Primary Examiner* — Hanh V Tran
(74) *Attorney, Agent, or Firm* — Price Heneveld LLP

(57) ABSTRACT

An appliance door assembly includes a front panel spaced apart from a rear panel. A door adjustment assembly is coupled with the rear panel and includes a housing that defines a cavity. A driven member is positioned within the cavity and extends at least partially from the housing. The driven member is movable between a first position and a second position. A driving member is rotatably engaged with the driven member and is configured to rotate the driven member. A bracket is coupled with the door adjustment assembly at a first end and coupled with the rear panel at a second end. The bracket abuts the housing of the door adjustment assembly when the driven member is in the first position and is spaced apart from the housing of the door adjustment assembly when the driven member is in the second position.

20 Claims, 15 Drawing Sheets

(56) References Cited

U.S. PATENT DOCUMENTS 8,511,761 B2 * 8/2013 Numanoglu ..... A47L 15/4265 312/204
9,101,211 B2 * 8/2015 Cabal Velarde ..... A47B 88/956
9,565,937 B1 * 2/2017 Jansen ..... A47B 88/45
9,752,817 B2 * 9/2017 Richards ..... F25D 23/028
9,841,221 B2 12/2017 Dubina et al.
10,575,639 B2 3/2020 Liu et al.
2008/0074019 A1 * 3/2008 Park ..... A47B 88/956 312/348.4
2010/0007249 A1 * 1/2010 Brown ..... F25D 23/021 312/109
2010/0218342 A1 * 9/2010 Bertolini ..... E05D 7/0027 16/244
2011/0210655 A1 * 9/2011 Brown ..... F25D 25/025 312/334.7
2013/0043780 A1 * 2/2013 Ootsuka ..... F25D 25/025 312/402
2014/0239787 A1 * 8/2014 Mensa' ..... A47B 88/956 312/348.4
2014/0306596 A1 * 10/2014 Linke ..... E05F 15/611 312/405
2015/0184928 A1 * 7/2015 Ozyuksel ..... A47L 15/4265 312/326
2015/0282617 A1 * 10/2015 Chen ..... A47B 96/14 312/348.4
2015/0305499 A1 * 10/2015 Rioja Calvo ..... A47B 88/956 403/408.1
2015/0338156 A1 * 11/2015 Held ..... E05D 7/00 312/405
2016/0018157 A1 * 1/2016 Dubina ..... F25D 23/04 312/404
2016/0174713 A1 * 6/2016 Dubina ..... A47B 88/40 29/434
2016/0209102 A1 * 7/2016 Vulava ..... E05D 15/56
2017/0241698 A1 * 8/2017 Dubina ..... F25D 25/025
2017/0318965 A1 * 11/2017 Hawkins ..... A47B 96/20
2018/0180348 A1 * 6/2018 Tamboli ..... F25D 23/04
2018/0202707 A1 * 7/2018 Park ..... F25D 23/04
2018/0224190 A1 * 8/2018 Yang ..... A47B 96/16
2019/0017739 A1 * 1/2019 Olvera ..... F25D 23/021
2019/0219324 A1 * 7/2019 Kang ..... F25D 25/025
2019/0269242 A1 * 9/2019 Liu ..... A47B 88/956
2019/0301789 A1 * 10/2019 Kim ..... F25D 25/025
2019/0308393 A1 * 10/2019 Allard ..... B32B 15/043

FOREIGN PATENT DOCUMENTS

DE 102009033086 A1 * 12/2010 ..... F25D 23/021
DE 102018204658 A1 * 10/2019 ..... F25D 23/067
JP 04329905 A * 11/1992
JP 2012026642 A * 2/2012
JP 2015031479 A * 2/2015 ..... F25D 23/02
JP 2019015475 A * 1/2019
KR 101101811 B1 1/2012

* cited by examiner

ADJUSTMENT ASSEMBLY FOR APPLIANCE DOOR

CROSS-REFERENCE TO RELATED APPLICATION

This application claims priority to and the benefit under 35 U.S.C. § 119(e) of U.S. Provisional Application No. 63/116,992, filed on Nov. 23, 2020, entitled "ADJUSTMENT ASSEMBLY FOR APPLIANCE DOOR," the disclosure of which is hereby incorporated herein by reference in its entirety.

BACKGROUND

The present device generally relates to assemblies for an adjustment bracket for an appliance door.

SUMMARY

In at least one aspect of the present disclosure, an appliance door assembly includes a front panel spaced apart from a rear panel. A door adjustment assembly is coupled with the rear panel and includes a housing that defines a cavity. A driven member is positioned within the cavity and extends at least partially from the housing. The driven member is movable between a first position and a second position. A driving member is rotatably engaged with the driven member and is configured to rotate the driven member. A bracket is coupled with the door adjustment assembly at a first end and coupled with the rear panel at a second end. The bracket abuts the housing of the door adjustment assembly when the driven member is in the first position and is spaced apart from the housing of the door adjustment assembly when the driven member is in the second position.

In another aspect of the present disclosure, an appliance door assembly includes a rear panel and a door adjustment assembly that is coupled with the rear panel. The door adjustment assembly includes a housing that defines a cavity. A driven member is positioned within the cavity. A driving member is rotatably engaged with the driven member. An operating end of the driving member extends from the housing. A bracket is coupled with the door adjustment assembly at a first end and coupled with the rear panel at a second end. The bracket is adjustable to abut the housing of the door adjustment assembly in a first condition and be spaced apart from the housing of the door adjustment assembly in a second condition.

These and other features, advantages, and objects of the present device will be further understood and appreciated by those skilled in the art upon studying the following specification, claims, and appended drawings.

Figure 1:
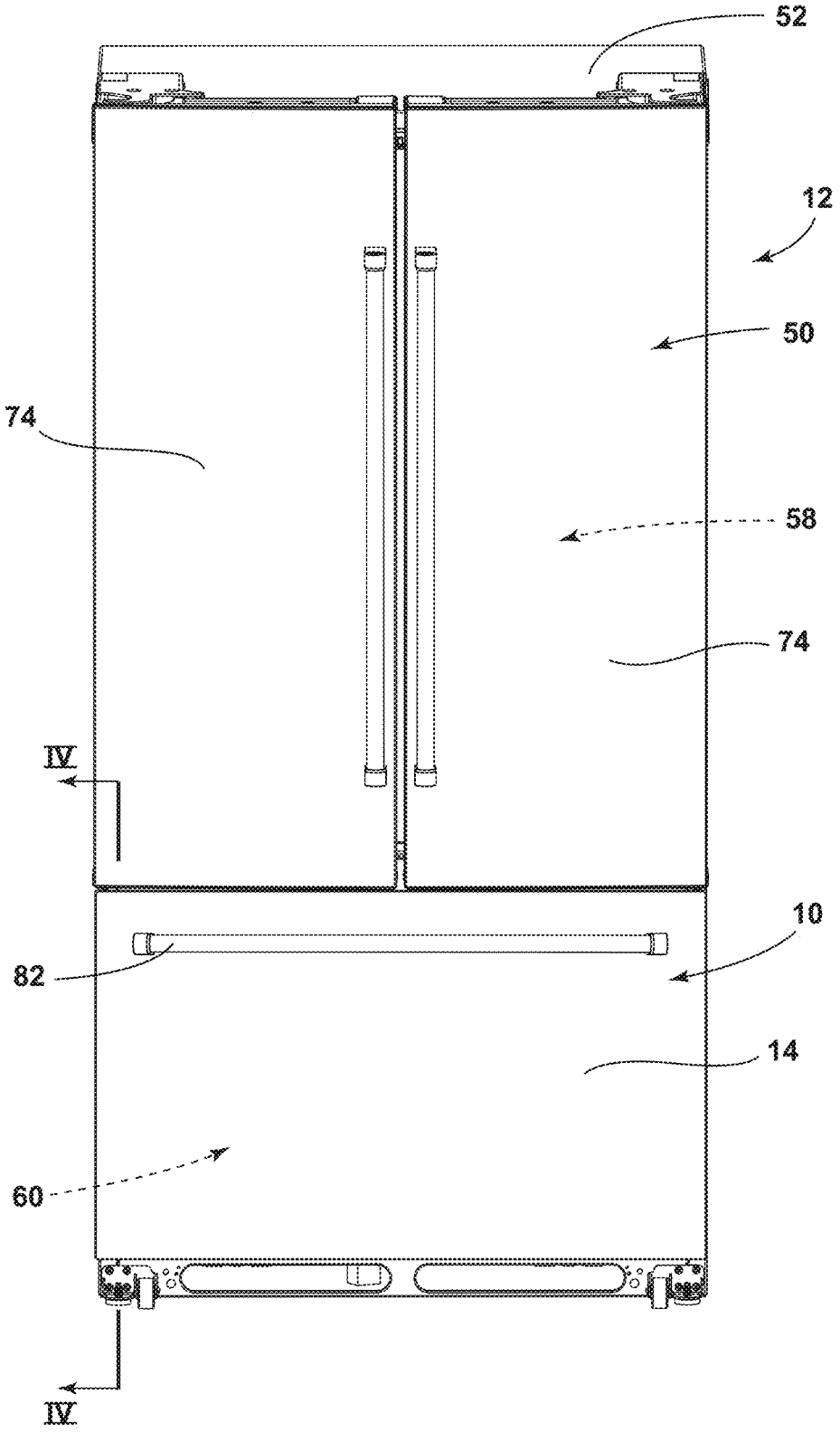
FIG. 1 is a front perspective view of an appliance including a sliding door assembly in a closed position, according to various examples.

The components in the figures are not necessarily to scale, emphasis instead being placed upon illustrating the principles described herein.

DETAILED DESCRIPTION OF EMBODIMENTS

The present illustrated embodiments reside primarily in combinations of method steps and apparatus components related to a door adjustment assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-14, reference numeral 10 generally designates a sliding door assembly for an appliance 12. The door assembly 10 includes a front panel 14 spaced apart from a rear panel 16. A door adjustment assembly 18 is coupled with the rear panel 16 and includes a housing 20 defining a cavity 22. A driven member 24 is positioned within the cavity 22 and extends at least partially from the housing 20. The driven member 24 is movable between a first position and a second position. A driving member 26 is rotatably engaged with the driven member 24. A bracket 28 is coupled with the door adjustment assembly 18 at a first end 30 and with the rear panel 16 at a second end 32. The bracket 28 contacts the housing 20 of the door adjustment assembly 18 when the driven member 24 is in the first position and is spaced apart from the housing 20 when the driven member 24 is in the second position. The door assembly 10 is movable between an open and closed position along a track assembly 34 operably coupled with the bracket 28.

Referring now to FIG. 1, the appliance 12 is illustrated as a refrigerator including a cabinet 50 having a wrapper 52 and one or more liners 54. The one or more liners 54 define a plurality of interior compartments 58, 60, including a refrigerator compartment 58 and a freezer compartment 60. The cabinet 50 of the appliance 12 can include a forward panel 64 that defines a plurality of openings 68, 70 corresponding with the plurality of interior compartments 58, 60. A pair of doors 74 is operable between a closed position and an open position to selectively provide access to the refrigerator compartment 58, and the sliding door assembly 10 is configured to selectively provide access to the freezer compartment 60. The configuration of the appliance 12 of FIG. 1 is exemplary only and the present concept is contemplated for use in all refrigerator styles having a sliding door assembly 10, including, but not limited to, side-by-side refrigerators, whole refrigerator and freezers, and refrigerators with upper freezer compartments.

The door assembly 10 includes the front panel 14 coupled with the rear panel 16. The front panel 14 may define an outer face of the door assembly 10 and is spaced apart from the rear panel 16 to define a space therebetween. As shown in FIG. 1, a handle 82 may be coupled with the front panel 14 to move the door assembly 10 between the open and closed positions. It is contemplated that any number of panels, members, and components may also be included in the door assembly 10 without departing from the scope of the present disclosure.

Figure 4:
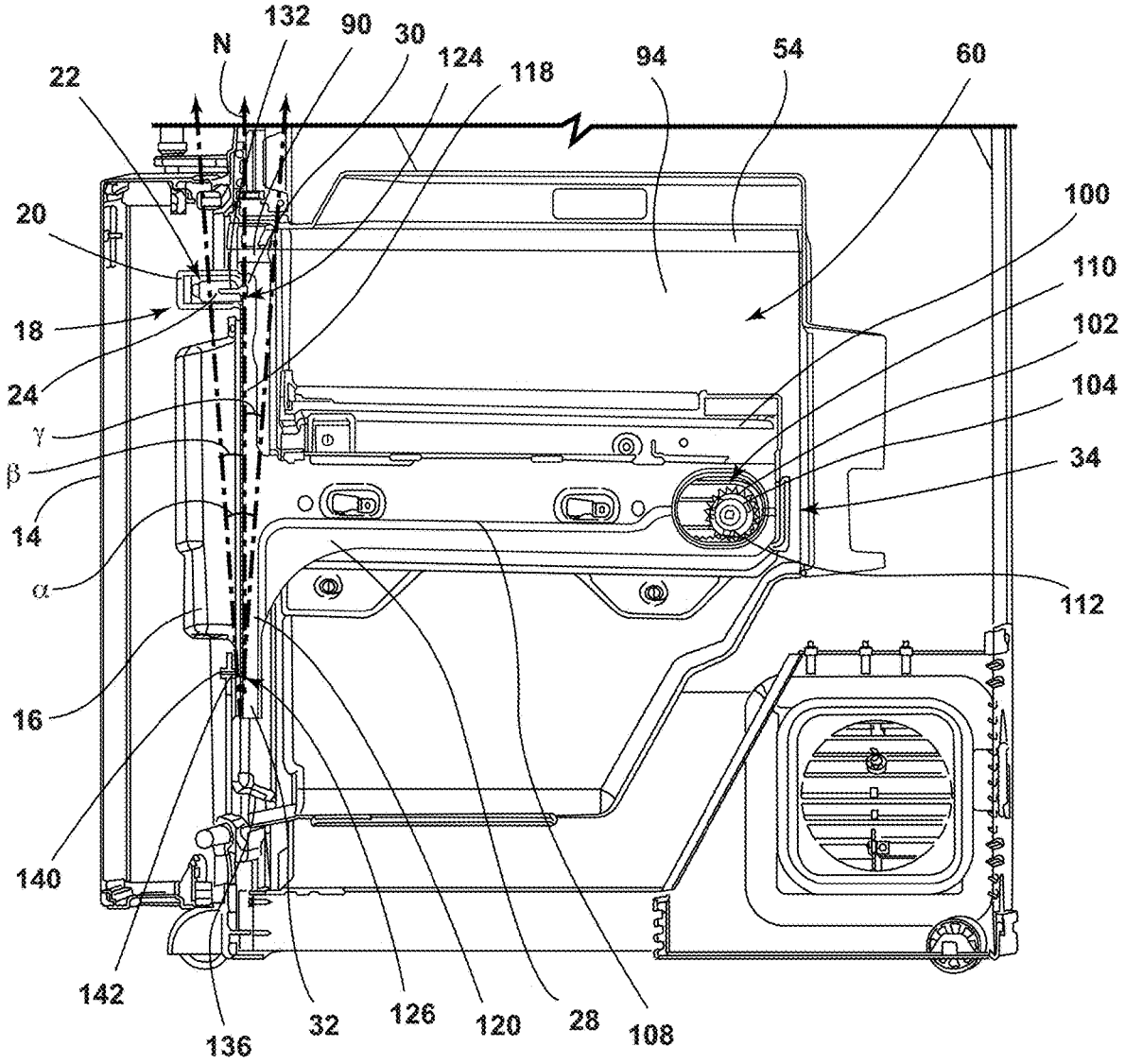
FIG. 4 is a partial cross-sectional view of the appliance of FIG. 1 taken along line IV-IV.

The rear panel 16 is configured to abut the front panel 14 of the appliance 12 when the door assembly 10 is in the closed position. As best shown in FIG. 4, the rear panel 16 may define an opening 88 proximate an upper edge 90 of the rear panel 16. The opening 88 may be configured to at least partially receive the adjustment assembly 18 for adjusting the position of the door assembly 10 relative to the front panel 14. For example, the adjustment assembly 18 may be configured to adjust the door assembly 10 such that the rear panel 16 is substantially parallel with the front panel 14 of the appliance 12 or at a desired angle relative to the front panel 14 of the appliance 12, as discussed in more detail herein. It is contemplated that the opening 88 may be positioned proximate the upper edge 90 or a lower edge 136 without departing from the scope of the present disclosure.

Figure 2:
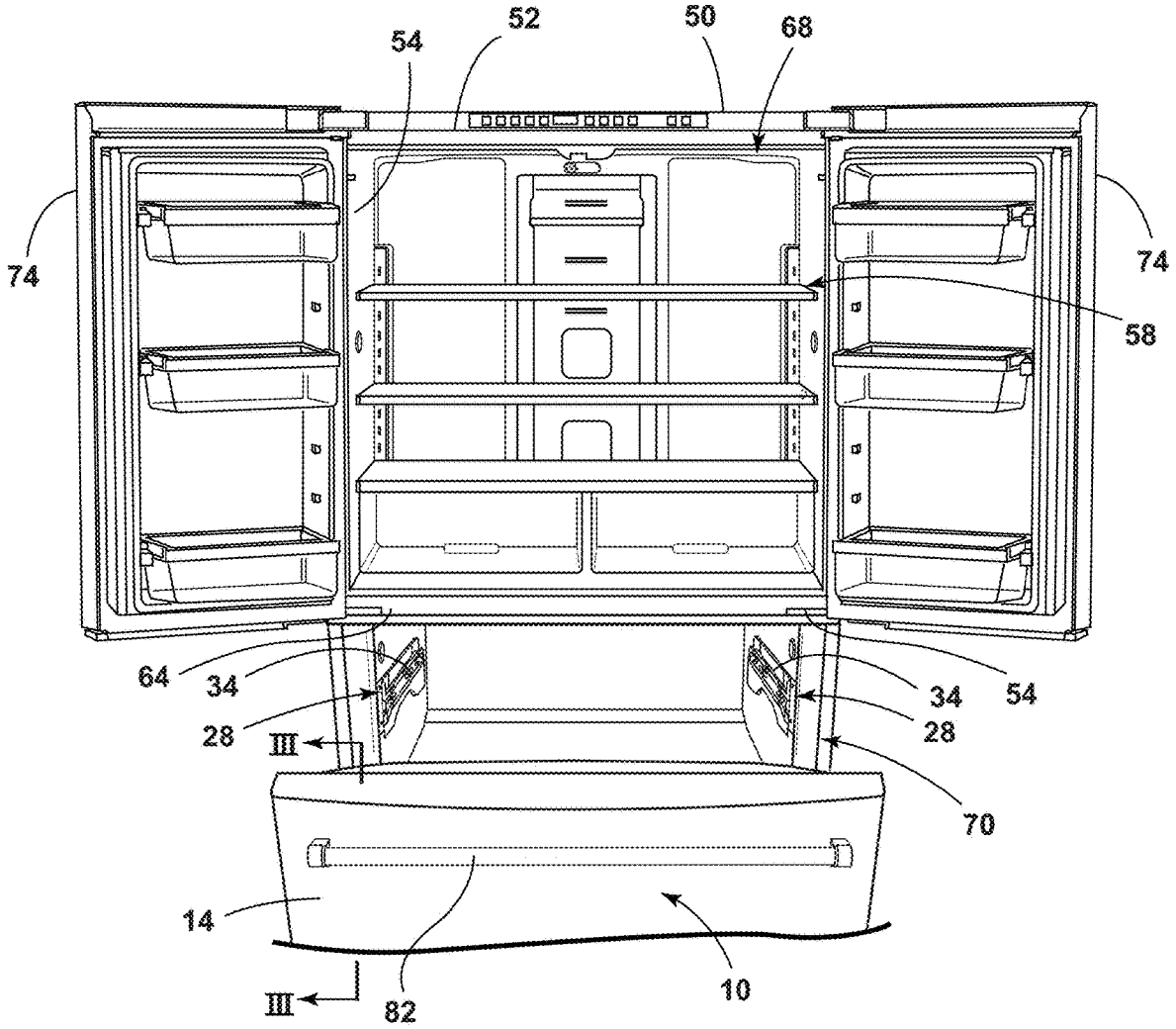
FIG. 2 is a front perspective view of the appliance of FIG. 1 with the sliding door assembly removed from an appliance body.

Referring now to FIG. 2, the door assembly 10 is slidably coupled with the cabinet 50 by the track assembly 34. While only a single track assembly 34, bracket 28, and door assembly 10 are described in detail herein, it will be understood that each sidewall 94 of the liner 54 defining the freezer compartment 60 may include a track assembly 34 and that each side of the door assembly 10 may include an adjustment assembly 18 and corresponding bracket 28 to be coupled with the corresponding track assembly 34. The track assemblies 34 may be configured as mirror-images of each other and operate concurrently.

Figure 3:
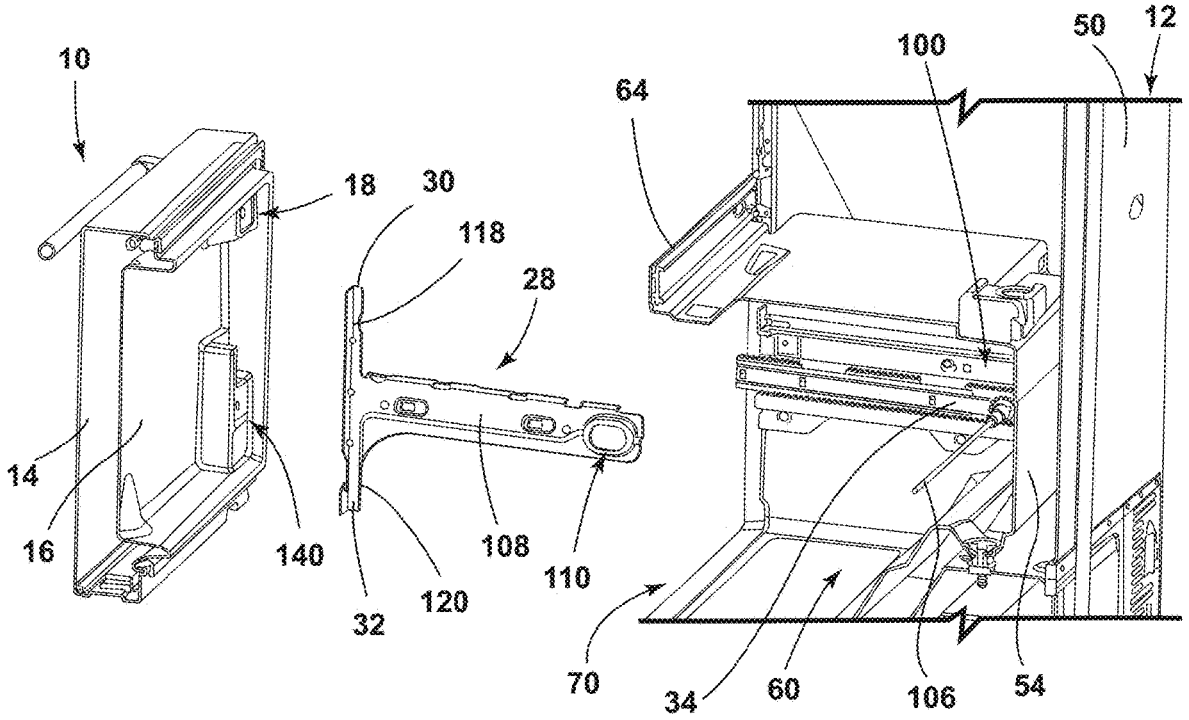
FIG. 3 is an exploded partial side perspective view of a cross-section of the appliance of FIG. 2 taken along line III-III.

As best shown in FIG. 3, each track assembly 34 includes a mount 100 coupled with the respective interior sidewall 94 of the liner 54 defining the freezer compartment 60. Each of the mounts 100 includes a corresponding gear 102 rotatably coupled with the mount 100 and including a plurality of teeth 104 (FIG. 4). Each of the gears 102 is configured to be engaged with a corresponding bracket 28 to slidably engage the bracket 28 with the mount 100. In various examples, where the track assemblies 34 are positioned on opposing sidewalls 94, the gear 102 of each track assembly 34 may be coupled with a cross-member 106 extending between the track assemblies 34 to ensure consistent rotation between the gears 102.

As previously introduced, the door assembly 10 is coupled with the track assembly 34 by the bracket 28. The bracket 28 includes a horizontal member 108 defining a receiving space 110 configured to receive the gear 102 of the track assembly 34. An inner portion of the gear 102 is engaged with an edge 112 defining the receiving space 110. As the gear 102 rotates in a first direction, the bracket 28 is moved outward of the opening 70 in communication with the freezer compartment 60. As the gear 102 rotates in a second, opposite direction, the bracket 28 is moved inward of the opening 70 and into the freezer compartment 60. In other words, the bracket 28 is operably coupled with the mount 100 and is movable relative to the mount 100 to move the door assembly 10 between an open position and a closed position. In other examples, the horizontal member 108 may be fixedly coupled with a rail slidably coupled with a track of the track assembly 34 or may be coupled in any other way to the track assembly 34 to allow the bracket 28 to be horizontally translated relative to the track assembly 34. As in other types of refrigerator sliding drawer assemblies, various other structures may be coupled with the door assembly 10 or related components of the associated appliance 12 to further adjust the position of the door assembly 10.

With reference again to FIG. 3, the bracket 28 further includes first and second arms 118, 120 extending from the horizontal member 108. The first and second arms 118, 120 may be substantially vertically oriented and are integrally formed with the horizontal member 108. The first arm 118 includes a first end 30 of the bracket 28, and the second arm 120 includes a second end 32 of the bracket 28. As previously introduced, the first end 30 of the bracket 28 is operably coupled with an adjustment assembly 18 of the door assembly 10. The first arm 118 defines a first receiving well 124 proximate the first end 30, and the second arm 120 defines a second receiving well 126 proximate the second end 32.

As previously introduced, the first end 30 of the bracket 28 is coupled with the adjustment assembly 18. In other words, the adjustment assembly 18 may be at least partially received by the first receiving well 124 or may be engaged with an upper fastener 132 extending through the first receiving well 124, as described in more detail elsewhere herein. The second end 32 of the bracket 28 is fixedly coupled with the rear panel 16 proximate a lower edge 136 of the rear panel 16. As illustrated in FIG. 3, a fastener housing 140 may be coupled or integrally formed with the rear panel 16 of the door assembly 10. The fastener housing 140 may be configured to house a fastener 142 (FIG. 4) or other coupling member (e.g., a pin, a screw, etc.) such that the fastener 142 extends outward from the rear panel 16. The fastener 142 may be received by the second receiving well 126 (FIG. 4) and is configured to couple the second end 32 of the second arm 120 of the bracket 28 with the rear panel 16.

Figure 5:
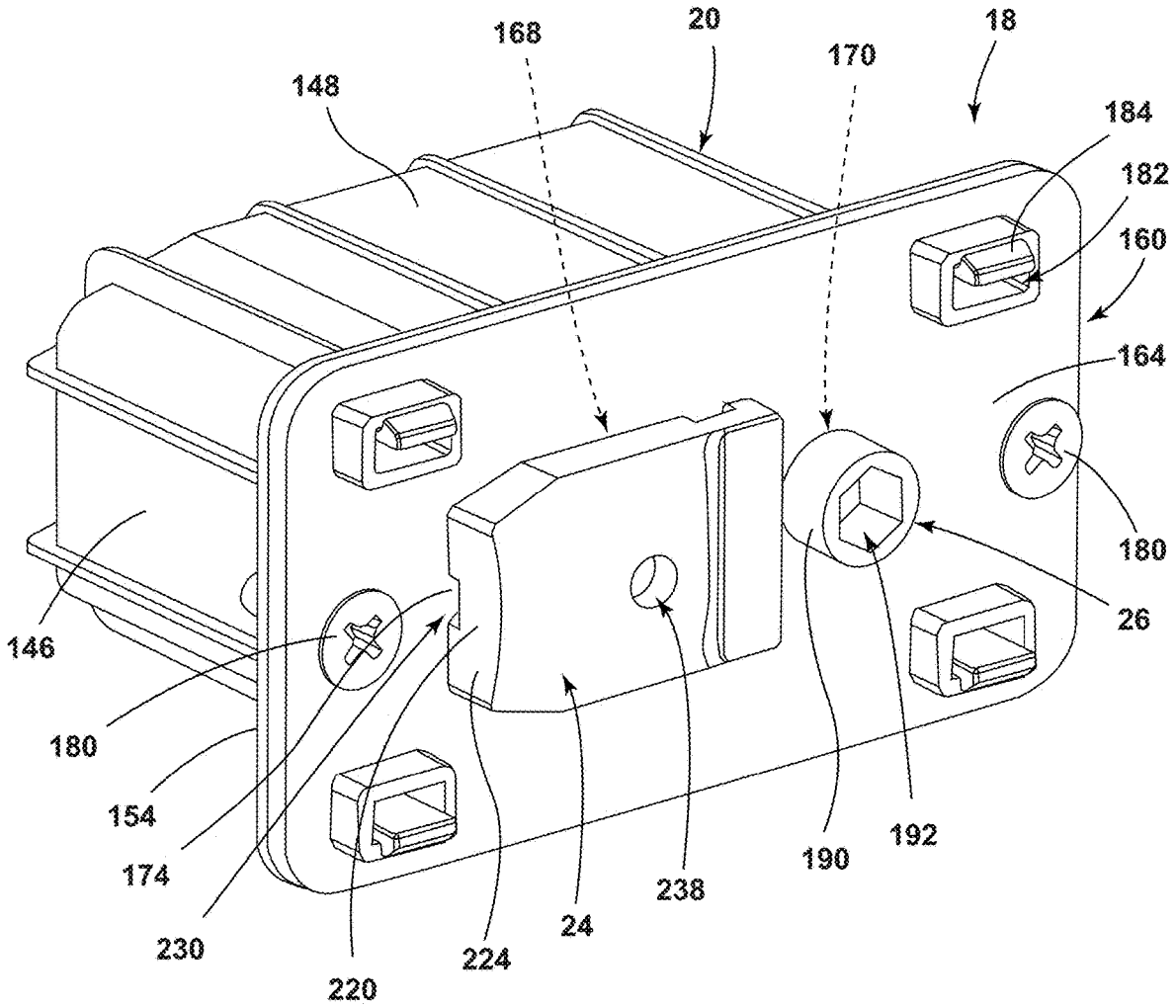
FIG. 5 is a side perspective view of an adjustment assembly, according to various examples.
Figure 6:
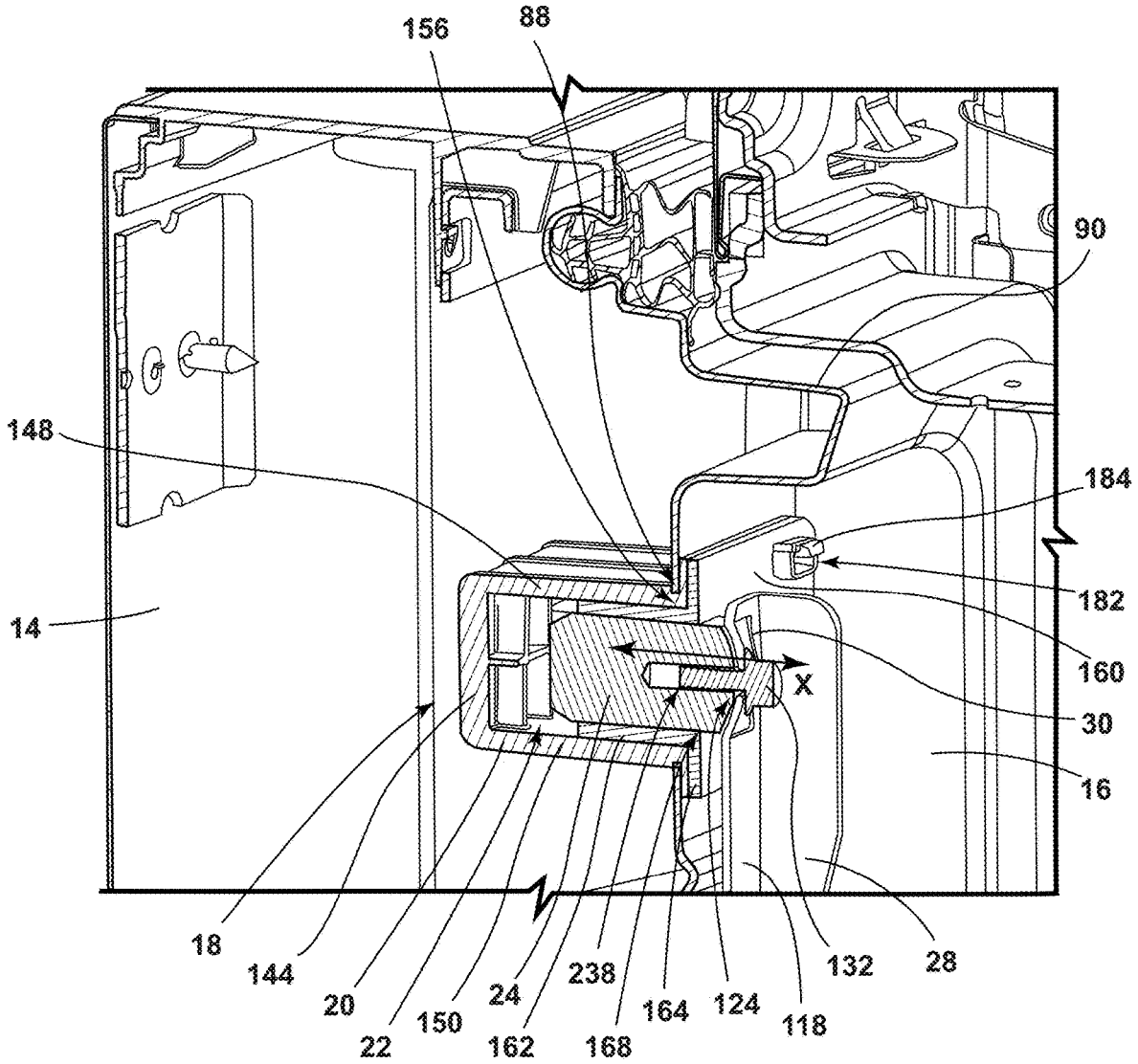
FIG. 6 is a partial side perspective view of a first cross-section of the sliding door assembly with the adjustment assembly of FIG. 5.
Figure 7:
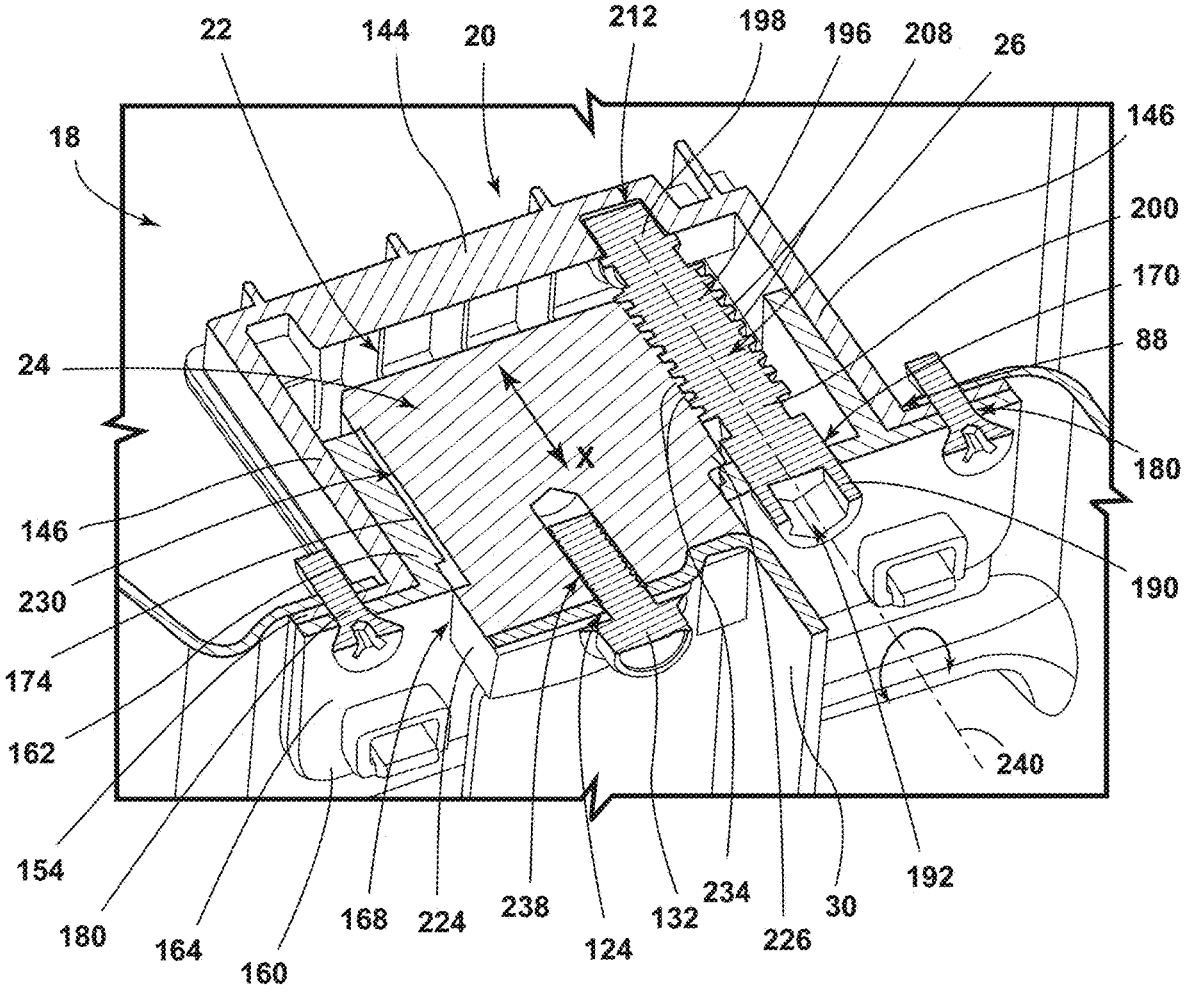
FIG. 7 is a partial top perspective view of a second cross-section of the sliding door assembly with the adjustment assembly of FIG. 5.

Referring now to FIGS. 5-7, an adjustment assembly 18 is illustrated according to various examples. The adjustment assembly 18 includes the housing 20, as previously introduced, defining the cavity 22. As shown in FIG. 5, the housing 20 includes a rear wall 144 integrally formed with sidewalls 146, a top wall 148, and a bottom wall 150. The housing 20 may have a substantially rectangular cross-section and may be at least partially received by the opening 88 of the rear panel 16. The housing 20 may further include a lip 154 extending outward from the plurality of walls 150 and defining an opening 156 in communication with the cavity 22. When the housing 20 is received by the opening 88 of the rear panel 16, the lip 154 may be positioned in contact with and/or aligned with the rear panel 16.

The adjustment assembly 18 may further include a cover 160. The cover 160 includes an insertion portion 162 and an outer portion 164. The outer portion 164 defines a first aperture 168 and a second aperture 170. The first aperture 168 is defined proximate the second aperture 170. The insertion portion 162 is configured to be at least partially received by the opening 156 and the cavity 22 of the housing 20. The insertion portion 162 further includes at least one protrusion 174 extending inward proximate the first aperture 168.

With reference to FIGS. 6 and 7, when the insertion portion 162 is positioned through the opening 156 and at least partially within the cavity 22, the outer portion 164 is positioned in contact with the lip 154 of the housing 20. A plurality of fasteners 180 are configured to extend through the outer portion 164, the lip 154, and the rear panel 16 to couple the housing 20 and the cover 160 with the rear panel 16 of the door assembly 10. In various examples, the cover 160 may also include clip apertures 182 (FIG. 6) configured to receive engagement arms 184 of the housing 20 to couple the housing 20 with the cover 160.

The driving member 26 is positioned within the cavity 22 of the housing 20 and extends at least partially through the second aperture 170 of the cover 160. The driving member 26 includes an actuating portion 190 extending through the second aperture 170 and outward of the cover 160. The actuating portion 190 may define a recess 192 configured to be rotated by a user or a mechanical tool to actuate the adjustment assembly 18, as discussed in more detail herein.

As shown in FIG. 7, the driving member 26 further includes a body portion 196 including a first end 198 and a second end 200 integrally formed with the actuating portion 190. The body portion 196 further includes a plurality of driving engagement members 208 extending circumferentially about the body portion 196 and configured as a plurality of threads. The second end 200 of the body portion 196 may be at least partially received by a receiving well 212 defined by the rear wall 144 of the housing 20 and may be rotatable therein.

The driven member 24 is positioned within the cavity 22 of the housing 20. The driven member 24 includes a body 220 having a substantially rectangular cross-section and including at least first and second sides 224, 226. The body 220 is configured to extend at least partially through the first aperture 168 of the cover 160. A guide 230 may be defined by the first side 224 of the body 220. The guide 230 may be configured to receive and engage with the protrusion 174 extending inward from the insertion portion 162 of the cover 160.

With reference again to FIG. 7, a plurality of driven engagement members 234 extend from the second side 226 of the body 220 and may be configured as teeth or threads. The plurality of driven engagement members 234 are configured to engage with the plurality of driving engagement members 208 extending from the body 220 of the driving member 26. The body 220 of the driven member 24 further defines a receiving space 238. The receiving space 238 is aligned with the first receiving well 124 of the first arm 118 of the bracket 28. As previously introduced, the upper fastener 132 is configured to extend through the first receiving well 124 of the first arm 118 and is received by the receiving space 238 of the body 220 to couple the body 220 of the adjustment assembly 18 with the first arm 118 of the bracket 28.

As illustrated in FIG. 3, the door adjustment assembly 18 is configured to adjust the position of the door assembly 10 relative to the appliance body 220 by moving the rear panel 16 of the door assembly 10 toward and away from the bracket 28. As previously introduced, the adjustment assembly 18 includes the driven member 24 movable between first and second positions. The driven member 24 may further be retained in any intermediate position therebetween.

When the driving member 26 is rotated about a central axis 240 in a first direction, the engagement between the plurality of driving engagement members 208 and the plurality of driven engagement members 234 moves the driven member 24 from the first position toward the second position (see arrow X of FIG. 7). This movement translates the driven member 24 through the first aperture 168 to increase the distance between the housing 20 and the first arm 118 of the bracket 28. Rotation in a second direction will result in decreasing the distance between the housing 20 and the first arm 118 of the bracket 28.

The rear panel 16 of the door assembly 10 is movable relative to the bracket 28 forward and rearward from a neutral position N, as shown in FIG. 4. In the neutral position, the rear panel 16 is aligned with, and spaced apart from, the bracket 28. Forward movement of the rear panel 16 from the neutral position N is configured to define an angle $\beta$ relative to the neutral position N, and rearward movement of the rear panel 16 from the neutral position N is configured to define an angle $\gamma$ relative to the neutral position. For example, when the adjustment assembly 18 moves the upper edge 90 of the rear panel 16 forward of the door assembly 10, the distance between the housing 20 and the bracket 28 is increased, simultaneously increasing the angle $\beta$. In other words, as the driving member 26 is rotated in the first direction, the distance between the housing 20 and the bracket 28 increases, and the increase in distance increases the angle $\beta$. When the driving member 26 is rotated in the second, opposite direction, the driven member 24 is withdrawn into the cavity 22 of the housing 20 through the first aperture 168. This reduces the distance between the rear panel 16 and the bracket 28 and subsequently decreases the angle $\beta$. The full range of motion of the rear panel 16 (e.g., the angle formed between the position of the rear panel 16 when the driven member 24 is in the first position and the position of the rear panel 16 when the driven member 24 is in the second position, is illustrated by angle $\alpha$. The angles $\beta$, $\gamma$ may be adjusted within this range of motion indicated by angle $\alpha$.

Figure 8:
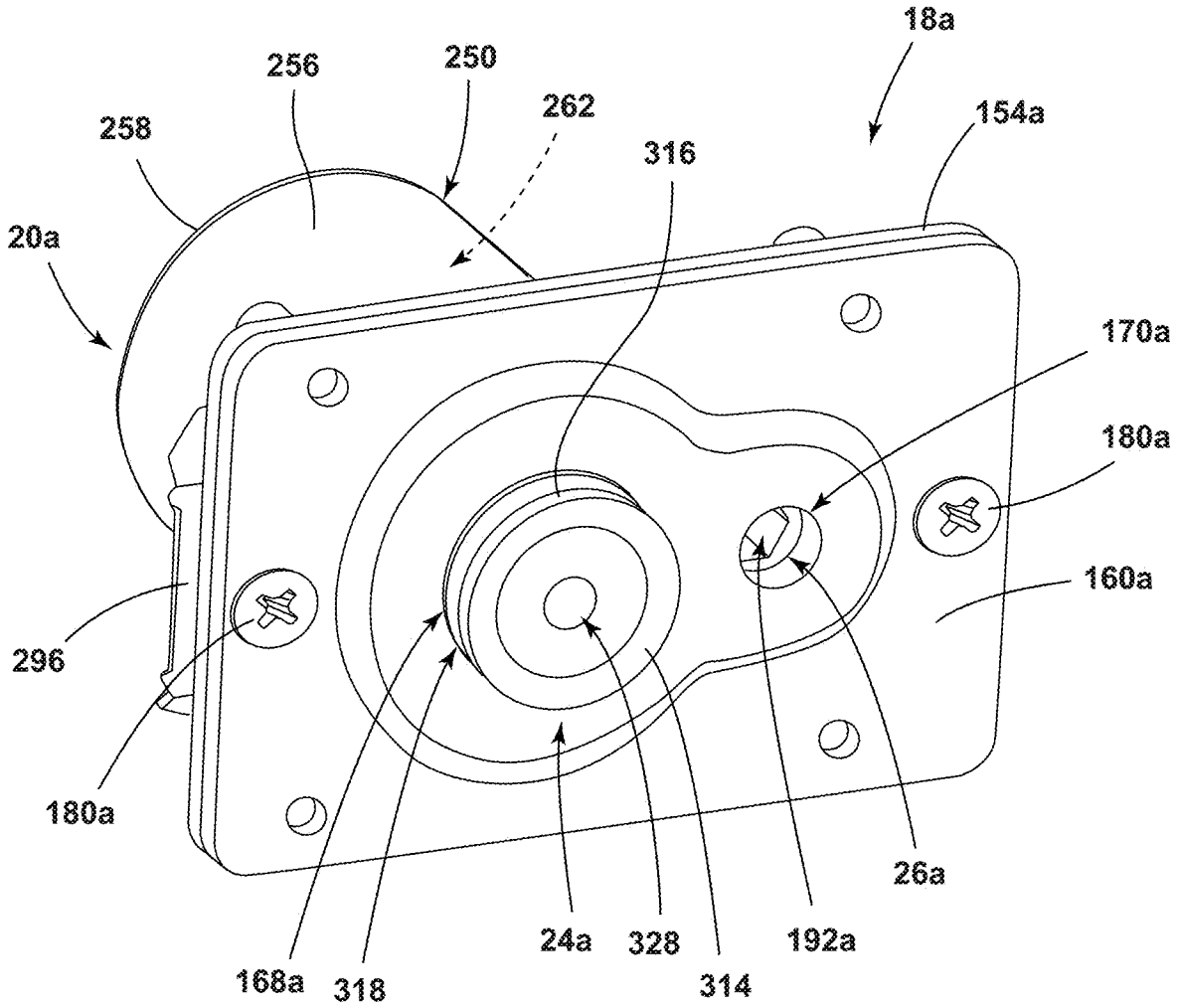
FIG. 8 is a side perspective view of an adjustment assembly, according to various examples.
Figure 9:
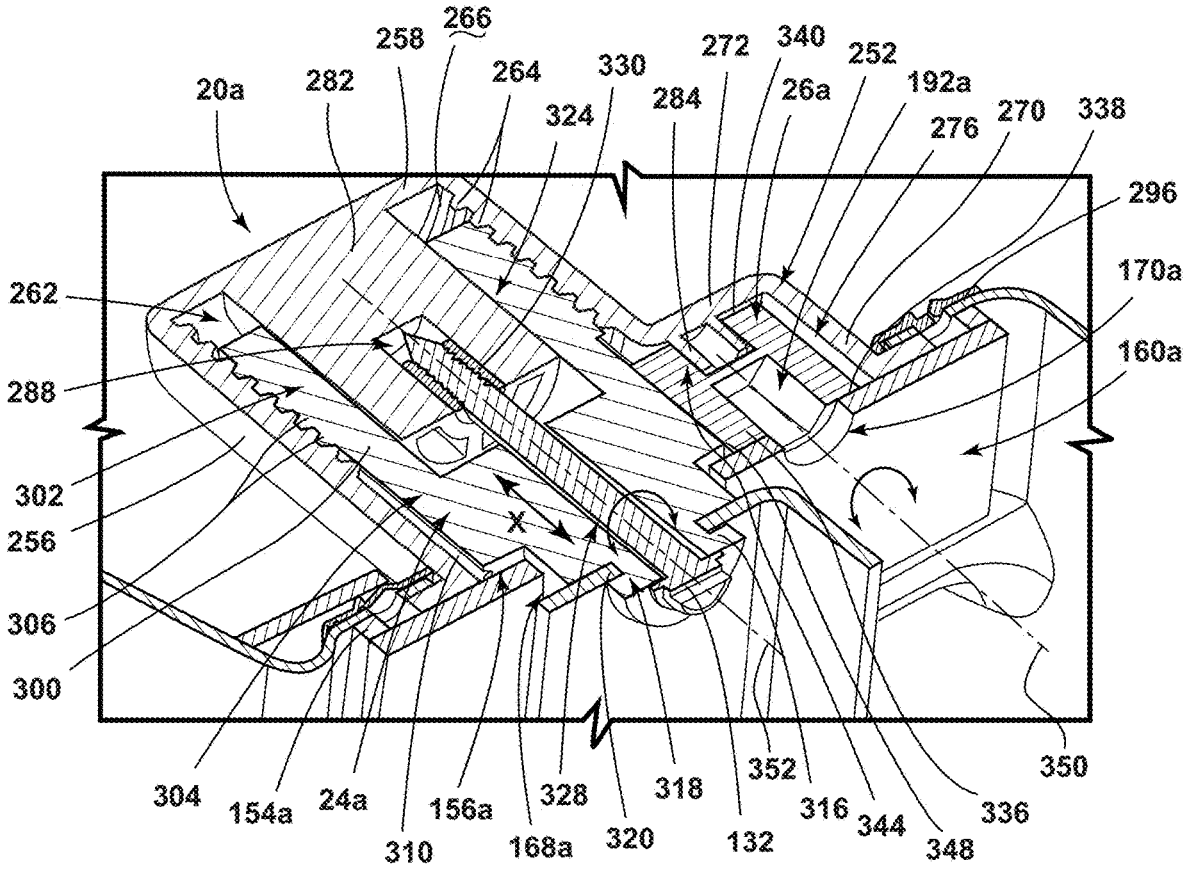
FIG. 9 is a partial top perspective view of a cross-section of the sliding door assembly with the adjustment assembly of FIG. 8.
Figure 10:
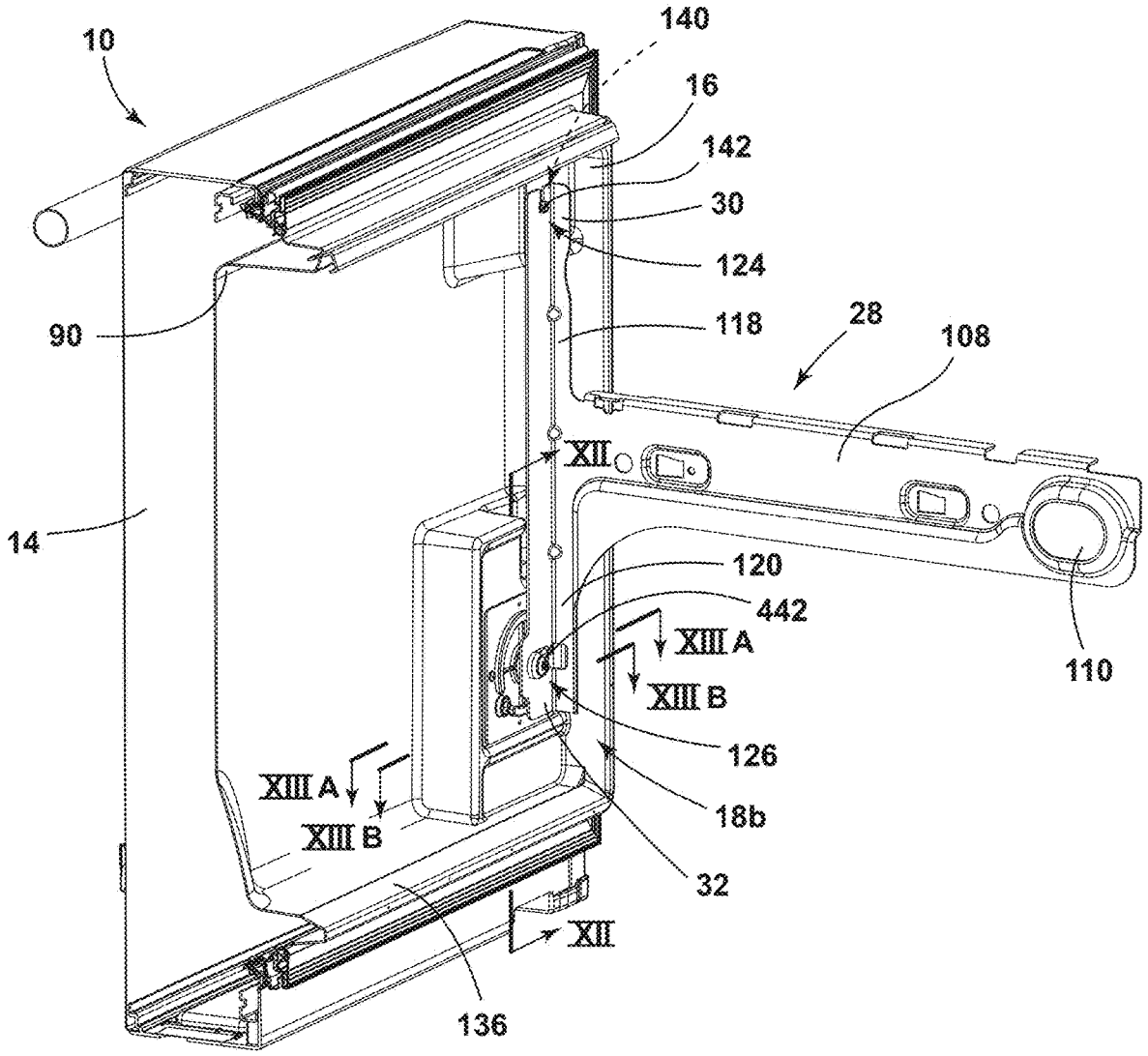
FIG. 10 is a cross-sectional side perspective view of a sliding door assembly having an adjustment assembly, according to various examples.

Referring now to FIGS. 8 and 9, a second adjustment assembly 18*a* for the door assembly 10 is illustrated according to various examples. The adjustment assembly 18*a* may be used in place of the adjustment assembly 18 previously described. The adjustment assembly 18*a* includes a housing

20*a* configured to receive a driven member 24*a* and a driving member 26*a*. The driven member 24*a* is coupled with the first arm 118 of the bracket 28 and is movable between first and second positions.

As shown in FIG. 9, the housing 20*a* includes a first portion 250 integrally formed with a second portion 252. The first portion 250 includes a first circumferential wall 256 and a first rear wall 258 and has a first substantially cylindrical shape. The first portion 250 defines a first cavity 262 configured to receive the driven member 24*a*. The first portion 250 further includes a first plurality of threads 264 extending inward from an inner surface 266 of the first circumferential wall 256 and configured to engage the driven member 24*a*, as discussed in more detail elsewhere herein.

The second portion 252 includes a second circumferential wall 270 and a second rear wall 272 integrally formed with the first circumferential wall 256. The second circumferential wall 270 and the second rear wall 272 extend from the first circumferential wall 256 to define a second cavity 276 of the housing 20*a*. The second cavity 276 has an at least partially cylindrical shape that is configured to intersect with the first portion 250 of the housing 20*a*. The second cavity 276 of the second portion 252 is in communication with the first cavity 262 at the intersection of the first and second portions 250, 252.

A first internal protrusion 282 extends into the first cavity 262 from the first rear wall 258 and defines an internal receiving space 288. The first internal protrusion 282 may be substantially cylindrical and may be spaced from the inner surface 266 of the first circumferential wall 256. A second internal protrusion 284 extends into the second cavity 276 from the second rear wall 272 and has a substantially cylindrical shape.

With continued reference to FIG. 9, the housing 20*a* further includes a lip 154*a* extending outward from the housing 20*a*. The lip 154*a* defines an opening 156*a* in communication with the first and second cavities 262, 276. When the housing 20*a* is received by the opening 88 of the rear panel 16, the lip 154*a* may be positioned in contact with and/or aligned with the rear panel 16.

A cover 160*a* is coupled with the housing 20*a*. As illustrated, the cover 160*a* is substantially planar and is shaped to complement the lip 154*a* of the housing 20*a*. The cover 160*a* defines a first aperture 168*a* configured to receive the driven member 24*a* and a second aperture 170*a* configured to be aligned with the driving member 26*a*. A plurality of fasteners 180*a* are configured to couple the cover 160*a* with the lip 154*a* of the housing 20*a* and the rear panel 16 of the door assembly 10. The plurality of fasteners 180*a* may further be configured to couple members 296 with the cover 160*a* through the housing 20*a* and the rear panel 16, as shown in FIG. 8.

The driven member 24*a* is configured to be positioned within the first cavity 262 and includes a body 300 having first and second portions 302, 304. The first portion 302 of the body 300 defines a second plurality of threads 306 extending circumferentially about the first portion 250. The second plurality of threads 306 are configured to be engaged with the first plurality of threads 264 extending the inner surface 266 of the first circumferential wall 256. The driven member 24*a* is configured to be rotated about a central axis 352 within the first cavity 262 such that the engagement between the first and second pluralities of threads 264, 306 moves the driven member 24*a* between first and second positions.

The second portion 304 of the body 300 of the driven member 24*a* includes a first plurality of teeth 310. The first plurality of teeth 310 extend radially along the second portion 304 and are spaced circumferentially about the second portion 304. The first plurality of teeth 310 are configured to be engaged with the driving member 26*a* to rotate the driven member 24*a* within the first cavity 262.

The driven member 24*a* further includes a coupling portion 314 extending from the second portion 252 of the body 300. The coupling portion 314 is configured to extend through the first aperture 168*a* of the cover 160*a*. In various examples, the driven member 24*a* may define a circumferential notch 318 between the coupling portion 314 and a lip 316. The notch 318 is configured to at least partially receive an interior edge 320 of the first arm 118 of the bracket 28. The interior edge 320 at least partially defines the first receiving well 124 of the bracket 28 such that the coupling portion 314 is on a first side of the bracket 28 and the lip 316 is on a second, opposing side of the bracket 28.

The driven member 24*a* is generally cylindrical defines a cylindrical receiving cavity 324 within at least the first portion 250 of the body 300. The receiving cavity 324 is configured to receive the first internal protrusion 282 of the housing 20*a*. When the driven member 24*a* is positioned within the first cavity 262 of the housing 20*a*, the first internal protrusion 282 is received by the receiving cavity 324 and the driven member 24*a* is rotatable about the first internal protrusion 282.

The driven member 24*a* further defines a receiving well 328 extending through the driven member 24*a* along a central axis 352. The receiving well 328 is configured to receive the upper fastener 132 to couple the adjustment assembly 18*a* with the bracket 28. As previously introduced, the first internal protrusion 282 of the housing 20*a* defines the internal receiving space 288. The internal receiving space 288 is aligned with the receiving well 328 of the driven member 24*a* and is configured to at least partially receive the upper fastener 132. A threaded insert 330 may be positioned within the internal receiving space 288 to couple the upper fastener 132 with the housing 20*a*.

As shown in FIGS. 8 and 9, the driving member 26*a* of the adjustment assembly 18*a* is positioned within the second cavity 276 of the housing 20*a*. The driving member 26*a* includes a body portion 336 having a first end 338 and a second end 340. The first end 338 of the body portion 336 defines a recess 192*a* and is configured to be used to actuate the driving member 26*a*. The recess 192*a* is aligned with the second aperture 170*a* of the cover 160*a* and is accessible through the second aperture 170*a* of the cover 160*a*. For example, a tool may be inserted through the second aperture 170*a* to engage with the recess 192*a* and rotate the driving member 26*a* about a central axis 350. The second end 340 of the body portion 336 defines a receiving well 344 configured to receive the second internal protrusion 284 of the housing 20*a*. The driving member 26*a* is rotatable about the second internal protrusion 284 and within the second cavity 276 of the housing 20*a*.

The driving member 26*a* further includes a second plurality of teeth 348 extending radially along the body portion 336 of the driving member 26*a* between the first and second ends 338, 340. The second plurality of teeth 348 are configured to be engaged with the first plurality of teeth 310 of the driven member 24*a* such that rotation of the driving member 26*a* results in rotation of the driven member 24*a*.

As previously discussed with reference to the adjustment assembly 18 of FIGS. 4-7, the door adjustment assembly 18*a* is configured to adjust the position of the door assembly 10 relative to the appliance body 220 by moving the rear panel 16 of the door assembly 10 toward and away from the bracket 28. As previously introduced, the adjustment assembly 18*a* includes the driven member 24*a* movable between first and second positions. The driven member 24*a* may further be retained in any intermediate position therebetween.

When the driving member 26*a* is rotated in a first direction, the engagement between the first and second pluralities of teeth 310, 348 causes the driven member 24*a* to rotate in a second opposite direction. The rotation of the driven member 24*a* in the second direction rotates the second plurality of threads 306 through the first plurality of threads 264 and translates the driven member 24*a* through the first aperture 168*a*, moving the driven member 24*a* from the first position toward the second position (arrow X of FIG. 9). The movement of the driven member 24*a* from the first position to the second position increases the distance between the housing 20*a* and the first arm 118 of the bracket 28.

The rear panel 16 of the door assembly 10 is movable relative to the bracket 28 forward and rearward from a neutral position N, as shown in FIG. 4. In the neutral position, the rear panel 16 is aligned with, and spaced apart from, the bracket 28. Forward movement of the rear panel 16 from the neutral position N is configured to define an angle β relative to the neutral position N, and rearward movement of the rear panel 16 from the neutral position N is configured to define an angle γ relative to the neutral position. For example, when the adjustment assembly 18*a* moves the upper edge 90 of the rear panel 16 forward of the door assembly 10, the distance between the housing 20*a* and the bracket 28 is increased, simultaneously increasing the angle β. In other words, as the driving member 26*a* is rotated in the first direction, the distance between the housing 20*a* and the bracket 28 increases, and the increase in distance increases the angle β. When the driving member 26*a* is rotated in the second, opposite direction, the driven member 24*a* is rotated in the first direction and is withdrawn into the first cavity 262 of the housing 20*a* through the first aperture 168*a*. This reduces the distance between the rear panel 16 and the bracket 28 and subsequently decreases the angle β. The full range of motion of the rear panel 16 (e.g., the angle formed between the position of the rear panel 16 when the driven member 24*a* is in the first position and the position of the rear panel 16 when the driven member 24*a* is in the second position, is illustrated by angle α. The angles β, γ may be adjusted within this range of motion indicated by angle α.

Referring now to FIGS. 10-14, a third adjustment assembly 18*b* for the door assembly 10 is illustrated according to various examples. The adjustment assembly 18*b* may be used in place of, or in conjunction with, the adjustment assembly 18 or the adjustment assembly 18*a* previously described. As illustrated, third adjustment assembly 18*b* is aligned with an opening 88*b* defined by the rear panel 16 proximate the lower edge 136 of the rear panel and is configured to be coupled with the second arm 120 of the bracket 28. The fastener housing 140 and the fastener 142 are positioned proximate the upper edge 90 of the rear panel 16 and are coupled with the first arm 118 of the bracket 28.

Figure 12:
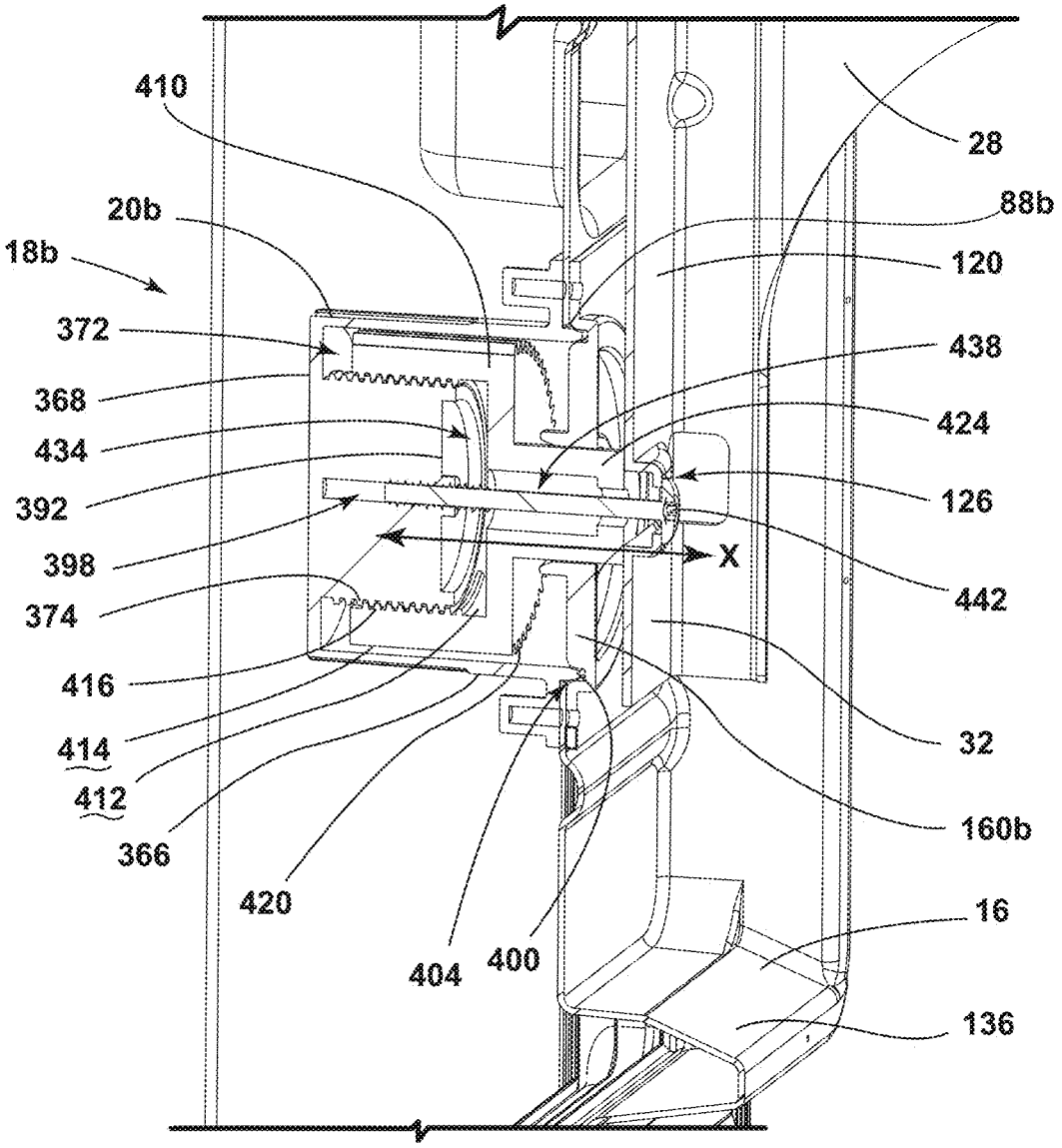
FIG. 12 is a partial side perspective view of a first cross-section of the sliding door assembly of FIG. 10 taken along line XII-XII.
Figure 13A:
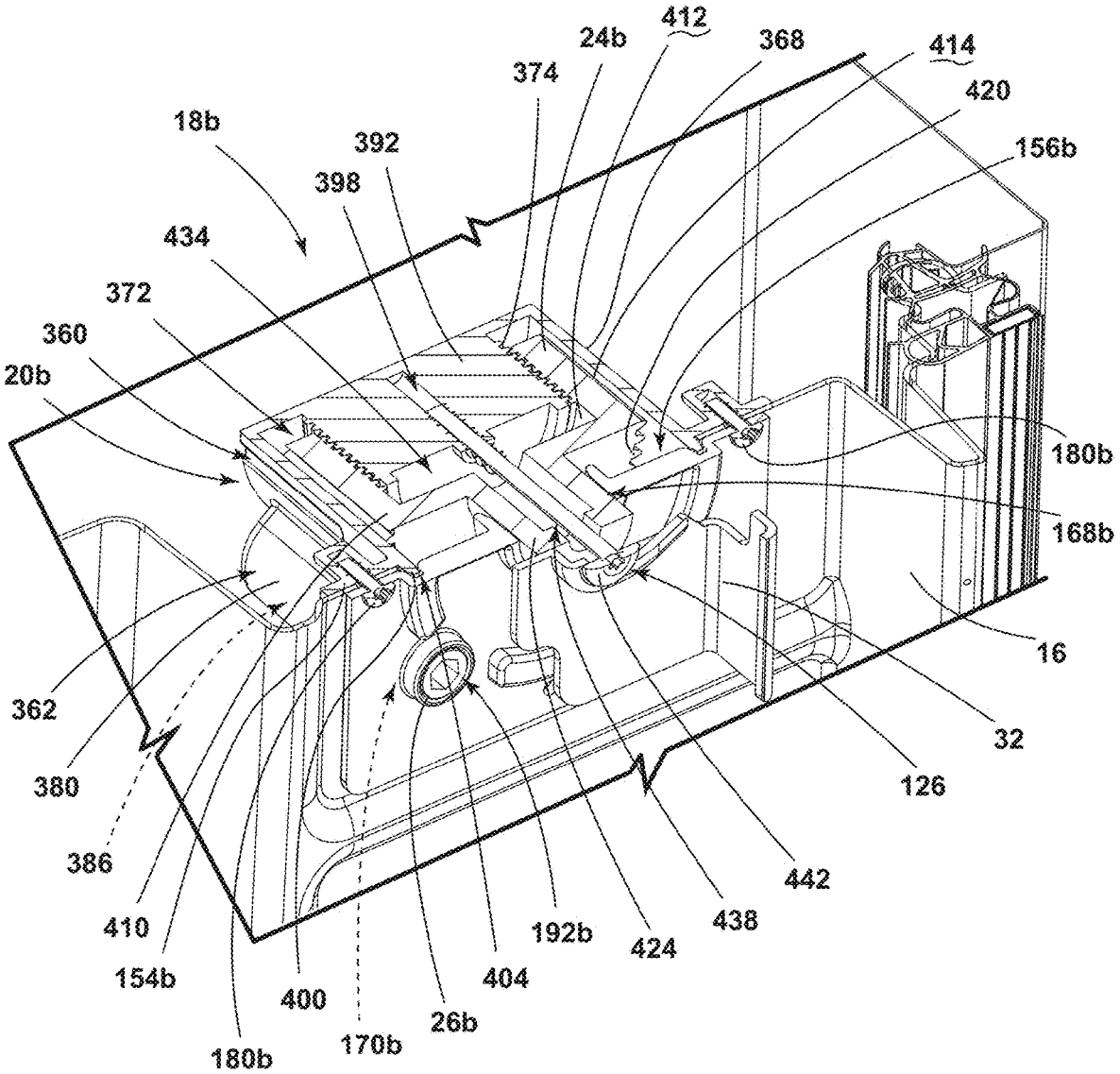
FIG. 13A is a partial top perspective view of a second cross-section of the sliding door assembly of FIG. 10 taken along line XIIIA-XIIIA.
Figure 13B:
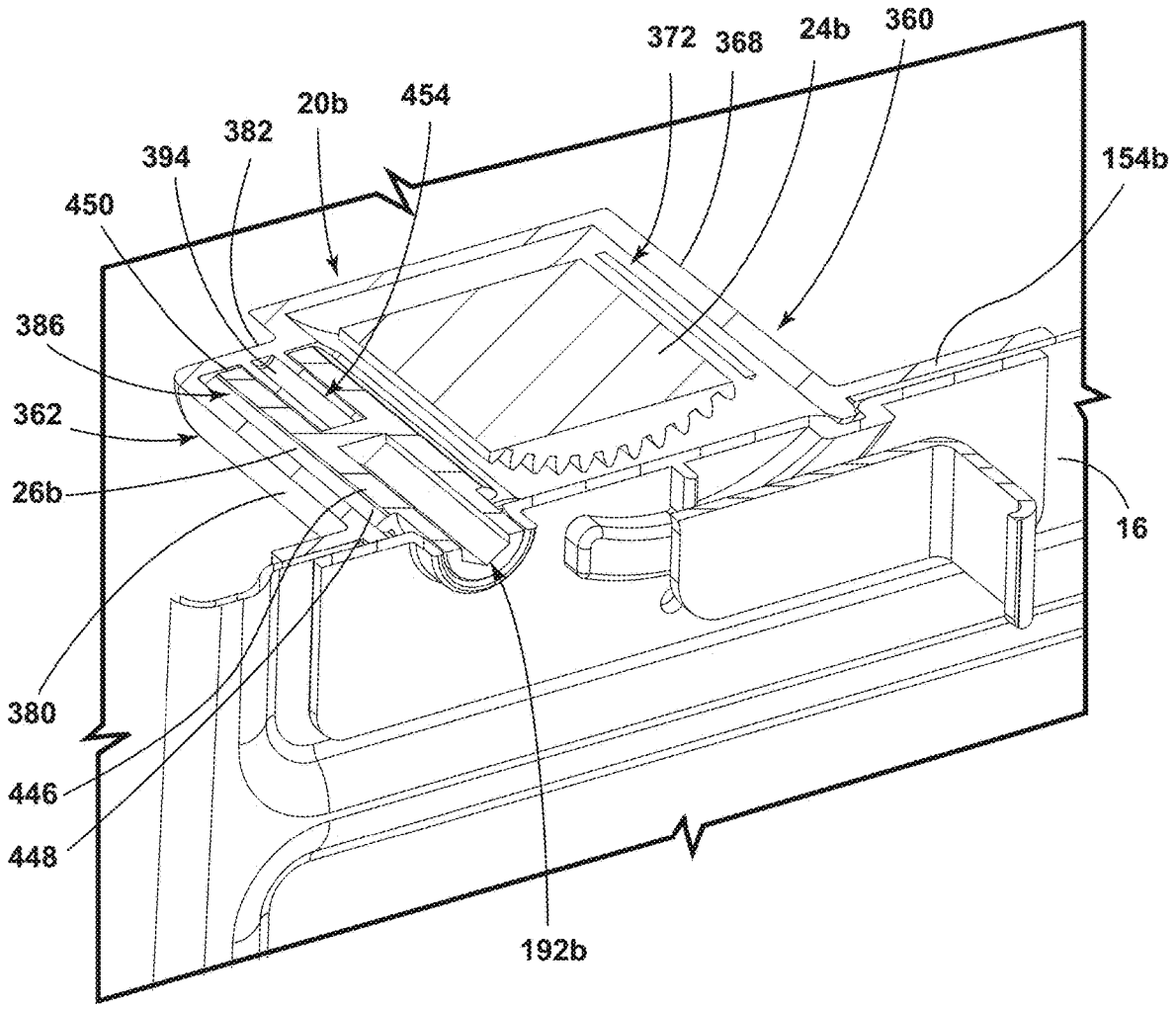
FIG. 13B is a partial top perspective view of a third cross-section of the sliding door assembly of FIG. 10 taken along line XIIIB-XIIIB.
Figure 14:
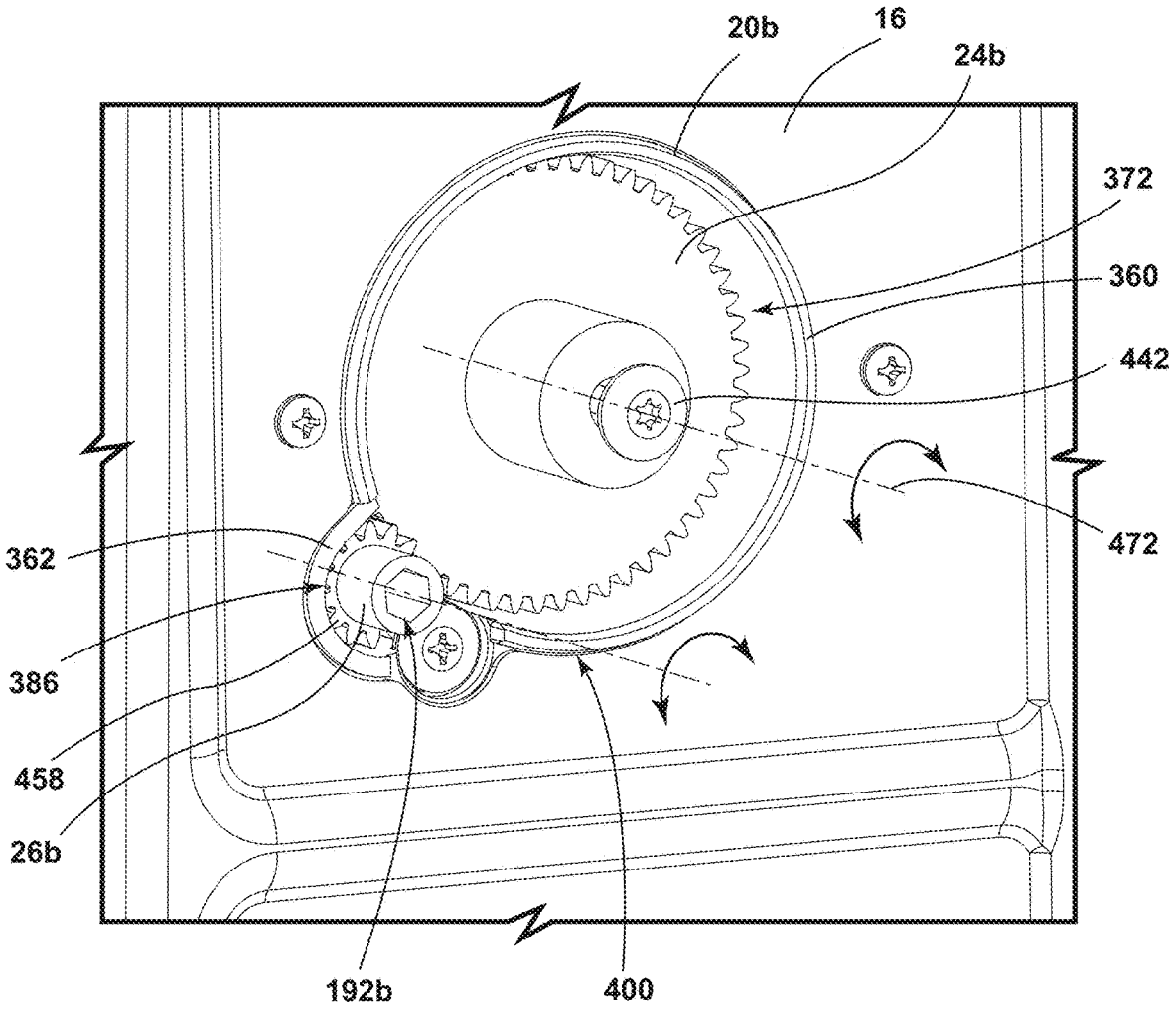
FIG. 14 is a side perspective view of the adjustment assembly of FIG. 10 with a cover removed.

As shown in FIGS. 12-14, the adjustment assembly 18*b* includes a housing 20*b* is configured to receive a driven member 24*b* and a driving member 26*b*. The driven member 24*b* is coupled with the second arm 120 of the bracket 28 and is movable between first and second positions. It will be understood that the adjustment assembly 18*b* may be with the previously described adjustment assemblies 18, 18*a* in place of the fastener housing 140 without departing from the scope of the present disclosure.

Referring now to FIGS. 12-13B, the housing 20*b* includes a first portion 360 integrally formed with a second portion 362. The first portion 360 includes a first circumferential wall 366 and a first rear wall 368 and has a first substantially cylindrical shape. As best shown in FIG. 13B, the second portion 362 includes a second circumferential wall 380 and a second rear wall 382 integrally formed with the first circumferential wall 366. The second circumferential wall 380 and the second rear wall 382 extend from the first circumferential wall 366 to define a second cavity 386 of the housing 20*b*.

The first portion 360 of the housing 20*b* defines a first cavity 372 configured to receive the driven member 24*b*, and the second portion 362 defines a second cavity 386 of the housing 20*b*. The second cavity 386 has an at least partially cylindrical shape that is configured to intersect with the first portion 360 of the housing 20*b*. The second cavity 386 of the second portion 362 is in communication with the first cavity 372 at the intersection of the first and second portions 360, 362.

As best shown in FIG. 12, the first portion 360 further includes a first internal protrusion 392. The first internal protrusion 392 extends into the first cavity 372 from the first rear wall 368 and defines an internal receiving space 398. The first internal protrusion 392 may be substantially cylindrical and may be spaced apart from the first circumferential wall 366. The first internal protrusion 392 further includes a first plurality of threads 374 extending outward from the first internal protrusion 392 and configured to engage the driven member 24*b*, as discussed in more detail elsewhere herein.

A second internal protrusion 394 extends into the second cavity 386 from the second rear wall 382 and had a substantially cylindrical shape. The second internal protrusion 394 is configured to be engaged with the driving member 26*b* such that the driving member 26*b* rotates about the second internal protrusion 394.

As shown in FIGS. 8 and 9, the housing 20*b* further includes a lip 154*b* extending outward from the housing 20*b*. The lip 154*b* defines an opening 156*b* in communication with the first and second cavities 262, 276. An extending edge 400 extends forward of the lip 154*b* and is positioned to extend about a portion of the perimeter of the opening 156*b*, as best shown in FIG. 8. The extending edge 400 is configured to be received by an opening 88*b* of the rear panel 16 when the housing 20*b* is coupled with the rear panel 16. When the extending edge 400 of the housing 20*b* is received by the opening 88*b* of the rear panel 16, the lip 154*b* may be positioned in contact with and/or aligned with the rear panel 16 and the extending edge 400 may extend past the rear panel 16.

A cover 160*b* is coupled with the housing 20*b*. As illustrated, the cover 160*b* is shaped to complement the lip 154*b* of the housing 20*b*. The cover 160*b* defines a first aperture 168*b* configured to receive the driven member 24*b* and a second aperture 170*b* configured to be aligned with the driving member 26*b*. A plurality of fasteners 180*b* are configured to couple the cover 160*b* with the lip 154*b* of the housing 20*b* and the rear panel 16 of the door assembly 10.

As shown in FIG. 12, the cover 160*b* may further define a guide 404 extending circumferentially about at least part of the first aperture 168*b*. The guide 404 is configured to receive the extending edge 400 of the housing 20*b* and is sized to complement the extending edge 400. In various examples, the guide 404 may be configured to guide the installation of the housing 20*b* and the cover 160*b* during assembly.

The driven member 24*b* is configured to be positioned within the first cavity 372 and includes a body 410 that is generally cylindrical. The body 410 includes an internal surface 412 defining a cylindrical receiving cavity 434 and an external surface 414 spaced apart from the first circumferential wall 366. The internal surface 412 of the body 410 includes a second plurality of threads 416 extending circumferentially along the internal surface 412 and protruding to the cylindrical receiving cavity 434. The driven member 24*b* further includes a coupling portion 424 extending from the body 410. The coupling portion 424 is configured extend through the first aperture 168*b* of the cover 160*b*.

The receiving cavity 434 is configured to receive the first internal protrusion 392 of the housing 20*b*. When the first internal protrusion 392 is received by the receiving cavity 434, the second plurality of threads 416 are configured to be engaged with the first plurality of threads 374 of the first internal protrusion 392. The driven member 24*b* is configured to be rotated within the first cavity 372 such that the engagement between the first and second pluralities of threads 374, 416 moves the driven member 24*b* between first and second positions.

The external surface 414 of the body 410 of the driven member 24*b* includes a first plurality of teeth 420. The first plurality of teeth 420 extending circumferentially about the body 410 of the driven member 24*b* and outward from the external surface 414. The first plurality of teeth 420 are configured to be engaged with the driving member 26*b* to rotate the driven member 24*b* within the first cavity 372.

The driven member 24*b* further defines a receiving well 438 extending through the driven member 24*b* along a central axis 472. The receiving well 438 is configured to receive an adjustment fastener 442 configured to couple the adjustment assembly 18*b* with the bracket 28. As previously introduced, the first internal protrusion 392 of the housing 20*b* defines the internal receiving space 398. The internal receiving space 398 is aligned with the receiving well 438 of the driven member 24*b* and is configured to at least partially receive the adjustment fastener 442.

As shown in FIGS. 13A-13B, the driving member 26*b* of the adjustment assembly 18*b* is positioned within the second cavity 386 of the housing 20*b*. The driving member 26*b* includes a body portion 446 having a first end 448 and a second end 450. The first end 448 of the body portion 446 defines a recess 192*b* and is configured to be used to actuate the driving member 26*b*. The second end 450 extends at least partially through the second aperture 170*b* of the cover 160*b* such that the recess 192*b* is accessible by a user. For example, a tool may be engaged with the recess 192*b* and rotate the driving member 26*b*. The second end 450 of the body portion 446 defines a receiving well 454 configured to receive the second internal protrusion 394 of the housing 20*b*. The driving member 26*b* is rotatable about the second internal protrusion 394 and within the second cavity 386 of the housing 20*b*.

The driving member 26*b* further includes a second plurality of teeth 458 extending radially along the body portion 446 of the driving member 26*b* between the first and second ends 448, 450. The second plurality of teeth 458 are configured to be engaged with the first plurality of teeth 420 of the driven member 24*b* such that rotation of the driving member 26*b* results in rotation of the driven member 24*b*.

As previously discussed with reference to the adjustment assembly 18 of FIGS. 4-7 and the adjustment assembly 18*a* of FIGS. 8 and 9, the door adjustment assembly 18*b* is configured to adjust the position of the door assembly 10 relative to the appliance body 220 by moving the rear panel 16 of the door assembly 10 toward and away from the bracket 28. As previously introduced, the adjustment assembly 18*b* includes the driven member 24*b* movable between first and second positions. The driven member 24*b* may further be retained in any intermediate position therebetween.

When the driving member 26*b* is rotated in a first direction, the engagement between the first and second pluralities of teeth 420, 458 causes the driven member 24*b* to rotate in a second opposite direction. The rotation of the driven member 24*b* in the second direction rotates the second plurality of threads 306 along the first plurality of threads 374 and translates the driven member 24*b* through the first aperture 168*b*, moving the driven member 24*b* from the first position toward the second position (see arrow X of FIG. 12). The movement of the driven member 24*b* from the first position to the second position increases the distance between the housing 20*b* and the second arm 120 of the bracket 28.

Figure 11:
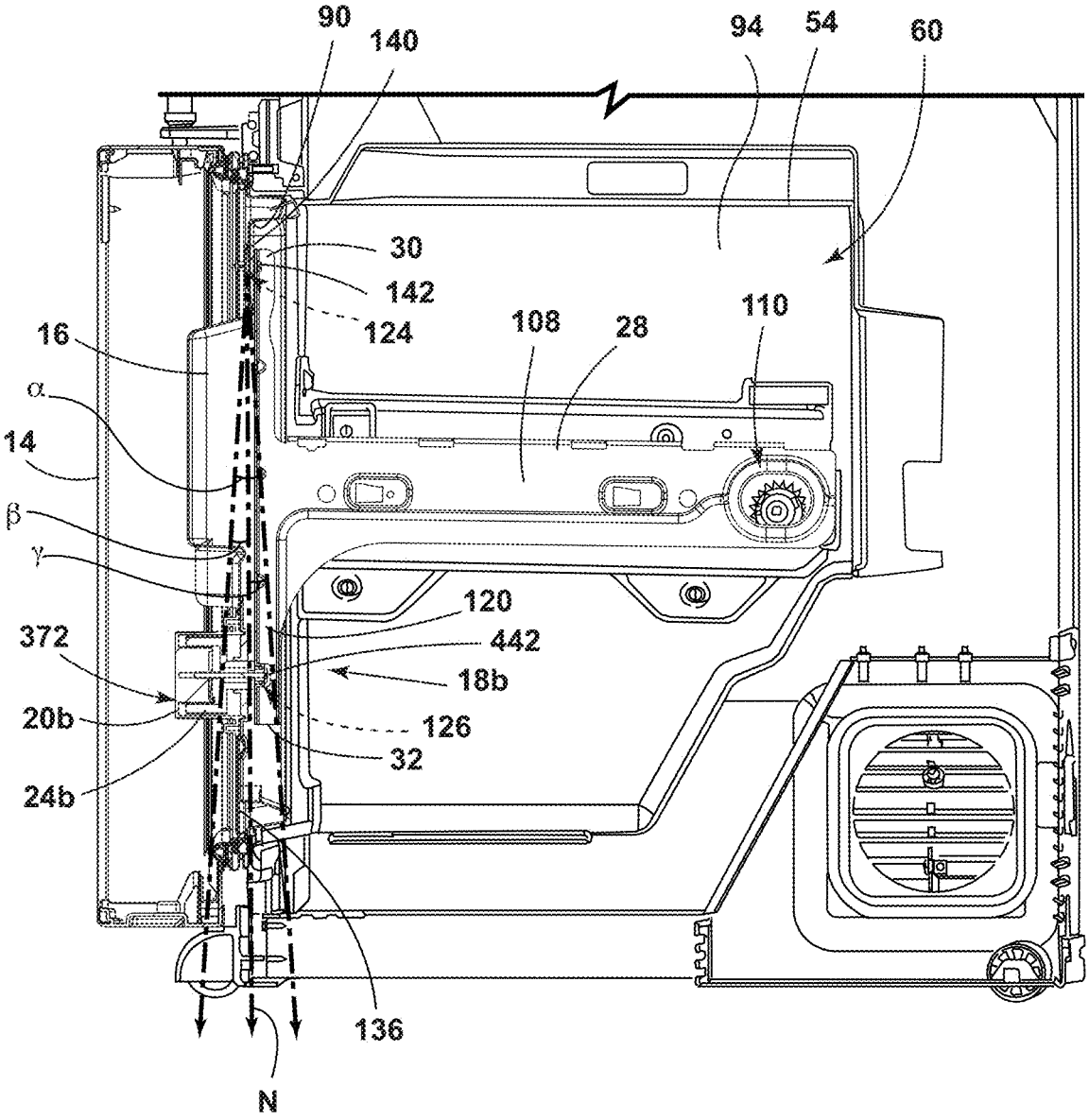
FIG. 11 is a partial cross-sectional view of an appliance including the sliding door assembly of FIG. 10.

The rear panel 16 of the door assembly 10 is movable relative to the bracket 28 forward and rearward from a neutral position N, as shown in FIG. 11. In the neutral position, the rear panel 16 is aligned with, and spaced apart from, the bracket 28. Forward movement of the rear panel 16 from the neutral position N is configured to define an angle β relative to the neutral position N, and rearward movement of the rear panel 16 from the neutral position N is configured to define an angle γ relative to the neutral position. For example, when the adjustment assembly 18*b* moves the upper edge 90 of the rear panel 16 forward of the door assembly 10, the distance between the housing 20*b* and the bracket 28 is increased, simultaneously increasing the angle β. In other words, as the driving member 26*b* is rotated in the first direction, the distance between the housing 20*b* and the bracket 28 increases, and the increase in distance increases the angle β. When the driving member 26*b* is rotated in the second, opposite direction, the driven member 24*b* is rotated in the first direction and is withdrawn into the first cavity 372 of the housing 20*b* through the first aperture 168*b*. This reduces the distance between the rear panel 16 and the bracket 28 and subsequently decreases the angle β. The full range of motion of the rear panel 16 (e.g., the angle formed between the position of the rear panel 16 when the driven member 24*a* is in the first position and the position of the rear panel 16 when the driven member 24*b* is in the second position, is illustrated by angle α. The angles β, γ may be adjusted within this range of motion indicated by angle α.

The ability to adjust the position of the rear panel 16 of the door assembly 10 relative to the bracket 28 provides flexibility to adjust the door assembly 10 to be parallel to the forward panel 64 of the appliance 12. This may reduce the formation of frost and/or gasket sealing issues and maintains a gap between the appliance cabinet 50 and the door assembly 10 within a specified range. This may also provide a user the ability to adjust the door assembly 10 to remedy frost formation and/or gasket sealing issues without having to replace components of the appliance 12 (e.g., the door assembly 10). It will be understood that the adjustment assembly 18, 18*a*, 18*b* and the bracket 28 described herein are directed to one of a pair of opposing adjustment assemblies 18 positioned on either side of the door assembly 10. It will further be understood that any number of adjustment assemblies 18, 18*a*, 18*b*, including a single adjustment assembly 18, 18*a*, 18*b* or more than two adjustment assemblies 18, 18*a*, 18*b*, and any number of brackets 28, including a single bracket 28 or more than two brackets 28, or any combination thereof may be used without departing from the scope of the present disclosure. Moreover, it will also be understood that the location of these adjustment assemblies 18, 18*a*, 18*b* and/or brackets 28 may be adjusted to accommodate various configurations of door assemblies 10 and appliances 12 without departing from the scope of the present disclosure.

According to a first aspect of the disclosure, an appliance door assembly includes a front panel spaced apart from a rear panel. A door adjustment assembly is coupled with the rear panel and includes a housing that defines a cavity. A driven member is positioned within the cavity and extends at least partially from the housing. The driven member is movable between a first position and a second position. A driving member is rotatably engaged with the driven member and is configured to rotate the driven member. A bracket is coupled with the door adjustment assembly at a first end and coupled with the rear panel at a second end. The bracket abuts the housing of the door adjustment assembly when the driven member is in the first position and is spaced apart from the housing of the door adjustment assembly when the driven member is in the second position.

According to another aspect of the disclosure, a driven member includes a first plurality of engagement members and a driving member includes a second plurality of engagement members. The second plurality of engagement members is rotatably engaged with the first plurality of engagement members.

According to still another aspect of the disclosure, rotation of a driving member in a first direction corresponds with rotation of a driven member in a second, opposite direction.

According to another aspect of the disclosure, rotation of a driving member in a first direction corresponds with movement of a driven member in a first linear direction and rotation of the driving member in a second, opposite direction corresponds with movement of the driven member in a second linear direction.

According to yet another aspect of the disclosure, a housing includes an inner surface defining a first plurality of threads extending into a cavity. A driven member includes a first portion that defines a first plurality of teeth and a second portion that defines a second plurality of threads. The second plurality of threads is engaged with the first plurality of threads of the housing. A driving member includes a second plurality of teeth that are engaged with the first plurality of teeth such that rotation of the driving member in a first direction corresponds with rotation of the driven member in a second, opposing direction. The first plurality of teeth extend radially along the driven member and the second plurality of teeth extend radially along the driving member.

According to another aspect of the disclosure, a housing includes an internal protrusion defining a first plurality of threads and a driven member defines a receiving cavity configured to receive the internal protrusion. The driven member defines a second plurality of threads configured to engage with the first plurality of threads.

According to another aspect of the disclosure, an operating end of a driving member extends from a housing.

According to still another aspect of the disclosure, an actuating portion of a driven member extends from a housing and is coupled with a bracket.

According to yet another aspect of the disclosure, a rear panel is aligned with arms of a bracket when a driven member is in a neutral position. The rear panel is positioned at a first angle relative to the neutral position when the driven member is in a first position and the rear panel is positioned at a second angle relative to the neutral position when the driven member is in a second position.

According to another aspect of the disclosure, an adjustment assembly includes a cover coupled with a housing that defines a first aperture and a second aperture. The first aperture is configured to at least partially receive a driven member and the second aperture is configured to at least partially receive a driving member.

According to still another aspect of the disclosure, a track assembly is coupled with a bracket. The bracket is moved in conjunction with a rail slide of the track assembly.

According to another aspect of the disclosure, an appliance door assembly includes a rear panel and a door adjustment assembly that is coupled with the rear panel. The door adjustment assembly includes a housing that defines a cavity. A driven member is positioned within the cavity. A driving member is rotatably engaged with the driven member. An operating end of the driving member extends from the housing. A bracket is coupled with the door adjustment assembly at a first end and coupled with the rear panel at a second end. The bracket is adjustable to abut the housing of the door adjustment assembly in a first condition and be spaced apart from the housing of the door adjustment assembly in a second condition.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. An appliance door assembly, comprising:
- a front panel spaced apart from a rear panel;
- a door adjustment assembly coupled with the rear panel and including:
  - a housing defining a cavity;
  - a driven member positioned within the cavity and extending at least partially from the housing, the driven member movable between a first position and a second position; and
  - a driving member engaged with the driven member and configured to translate the driven member; and
- a bracket coupled with the door adjustment assembly at a first end and coupled with the rear panel at a second end, wherein the bracket abuts the housing of the door adjustment assembly when the driven member is in the first position and is spaced apart from the housing of the door adjustment assembly when the driven member is in the second position.

2. The appliance door assembly of claim 1, wherein the driven member includes a first plurality of engagement members and the driving member includes a second plurality of engagement members, the second plurality of engagement members rotatably engaged with the first plurality of engagement members.

3. The appliance door assembly of claim 1, wherein rotation of the driving member in a first direction corresponds with rotation of the driven member in a second, opposite direction.

4. The appliance door assembly of claim 1, wherein rotation of the driving member in a first direction corresponds with movement of the driven member in a first linear direction and rotation of the driving member in a second, opposite direction corresponds with movement of the driven member in a second linear direction.

5. The appliance door assembly of claim 1, wherein the housing includes an inner surface defining a first plurality of threads extending into the cavity.

6. The appliance door assembly of claim 5, wherein the driven member includes a first portion defining a first plurality of teeth and a second portion defining a second plurality of threads, the second plurality of threads engaged with the first plurality of threads of the housing.

7. The appliance door assembly of claim 6, wherein the driving member includes a second plurality of teeth engaged with the first plurality of teeth such that rotation of the driving member in a first direction corresponds with rotation of the driven member in a second, opposing direction.

8. The appliance door assembly of claim 7, wherein the first plurality of teeth extends radially along the driven member and the second plurality of teeth extends radially along the driving member.

9. The appliance door assembly of claim 1, wherein the housing includes an internal protrusion defining a first plurality of threads and the driven member defines a receiving cavity configured to receive the internal protrusion, and further wherein the driven member defines a second plurality of threads configured to engage with the first plurality of threads.

10. The appliance door assembly of claim 1, wherein an operating end of the driving member extends from the housing.

11. The appliance door assembly of claim 1, wherein an actuating portion of the driven member extends from the housing and is coupled with the bracket.

12. The appliance door assembly of claim 1, wherein the rear panel is aligned with arms of the bracket when the driven member is in a neutral position, the rear panel is positioned at a first angle relative to the neutral position when the driven member is in the first position, and the rear panel is positioned at a second angle relative to the neutral position when the driven member is in the second position.

13. The appliance door assembly of claim 1, wherein the adjustment assembly further includes:
- a cover coupled with the housing and defining a first aperture and a second aperture, wherein the first aperture is configured to at least partially receive the driven member and the second aperture is configured to at least partially receive the driving member.

14. The appliance door assembly of claim 1, further comprising:
- a track assembly coupled with the bracket, wherein the bracket is moved in conjunction with a rail slide of the track assembly.

15. An appliance door assembly, comprising:
- a rear panel;
- a door adjustment assembly coupled with the rear panel and including:
  - a housing defining a cavity;
  - a driven member positioned within the cavity; and
  - a driving member rotatably engaged with the driven member, wherein an operating end of the driving member extends from the housing; and
- a bracket coupled with the door adjustment assembly at a first end and coupled with the rear panel at a second end, wherein the bracket is adjustable to abut the housing of the door adjustment assembly in a first condition and be spaced apart from the housing of the door adjustment assembly in a second condition.

16. The appliance door assembly of claim 15, wherein rotation of the driving member in a first direction corresponds with movement of the driven member in a first linear direction and rotation of the driving member in a second, opposite direction corresponds with movement of the driven member in a second linear direction.

17. The appliance door assembly of claim 1, wherein the housing includes an inner surface defining a first plurality of threads extending into the cavity.

18. The appliance door assembly of claim 17, wherein the driven member includes a first portion defining a first plurality of teeth and a second portion defining a second plurality of threads, the second plurality of threads engaged with the first plurality of threads of the housing.

19. The appliance door assembly of claim 18, wherein the driving member includes a second plurality of teeth engaged with the first plurality of teeth such that rotation of the driving member in a first direction corresponds with rotation of the driven member in a second, opposing direction.

20. The appliance door assembly of claim 19, wherein the first plurality of teeth extends radially along the driven member and the second plurality of teeth extends radially along the driving member.

* * * * *